US009764198B2

(12) United States Patent
Sullivan et al.

(10) Patent No.: US 9,764,198 B2
(45) Date of Patent: Sep. 19, 2017

(54) GOLF BALLS HAVING TRANSLUCENT COVERS FORMED OF AROMATIC AND ALIPHATIC POLYURETHANES

(71) Applicant: Acushnet Company, Fairhaven, MA (US)

(72) Inventors: Michael J. Sullivan, Old Lyme, CT (US); Mark L. Binette, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/160,146

(22) Filed: May 20, 2016

(65) Prior Publication Data

US 2016/0263443 A1 Sep. 15, 2016

Related U.S. Application Data

(63) Continuation of application No. 13/361,248, filed on Jan. 30, 2012, now abandoned, which is a continuation-in-part of application No. 13/330,056, filed on Dec. 19, 2011, now Pat. No. 9,044,648, which is a continuation-in-part of application No. 12/403,703, filed on Mar. 13, 2009, now Pat. No. 8,262,510.

(51) Int. Cl.

| | |
|---|---|
| ***A63B 37/06*** | (2006.01) |
| ***A63B 37/00*** | (2006.01) |
| ***A63B 37/12*** | (2006.01) |
| ***A63B 43/06*** | (2006.01) |

(52) U.S. Cl.

CPC ..... *A63B 37/0076* (2013.01); *A63B 37/0003* (2013.01); *A63B 37/0023* (2013.01); *A63B 37/0024* (2013.01); *A63B 37/0031* (2013.01); *A63B 37/0033* (2013.01); *A63B 37/0037* (2013.01); *A63B 37/0045* (2013.01); *A63B 37/0049* (2013.01); *A63B 37/12* (2013.01); *A63B 43/06* (2013.01)

(58) Field of Classification Search

CPC ..... A63B 37/0038
USPC ..... 473/376
See application file for complete search history.

(56) References Cited

U.S. PATENT DOCUMENTS

| | | | |
|---|---|---|---|
| 4,798,386 | A | 1/1989 | Berard |
| 4,998,734 | A | 3/1991 | Meyer |
| 5,334,673 | A | 8/1994 | Wu |
| 5,484,870 | A | 1/1996 | Wu |

(Continued)

*Primary Examiner* — Raeann Gorden
(74) *Attorney, Agent, or Firm* — Daniel W. Sullivan

(57) ABSTRACT

Golf balls having multi-layered covers, wherein at least one of the cover layers is substantially transparent, are provided. The cover includes an inner cover layer made of an ionomer composition; an intermediate cover layer made of an aromatic polyurethane composition; and outer cover layer made of an aliphatic polyurethane composition, wherein the total thickness of the multi-layered cover is no greater than 0.110 inches. In one version, the outer cover layer is substantially transparent and the underlying intermediate cover layer is colored. In another version, both the outer and intermediate cover layers are substantially transparent. Light-reflective fillers such as pearlescent pigments, glitter, and metallics may be added to the cover layers. The resulting ball has pleasing decorative effects.

3 Claims, 2 Drawing Sheets

(56) References Cited

U.S. PATENT DOCUMENTS

| | | | |
|---|---|---|---|
| 5,530,083 | A | 6/1996 | Phelps et al. |
| 5,542,680 | A | 8/1996 | Proudfit et al. |
| 5,863,627 | A | 1/1999 | Szcher et al. |
| 6,056,650 | A | 5/2000 | Yamagishi et al. |
| 6,117,025 | A | 9/2000 | Sullivan |
| 6,129,640 | A | 10/2000 | Higuchi et al. |
| 6,135,898 | A | 10/2000 | Higuchi et al. |
| 6,152,834 | A | 11/2000 | Sullivan |
| 6,231,460 | B1 | 5/2001 | Higuchi et al. |
| 6,394,914 | B1 | 5/2002 | Sullivan |
| 6,476,176 | B1 | 11/2002 | Wu |
| 6,506,851 | B2 | 1/2003 | Wu |
| 6,561,928 | B2 | 5/2003 | Binette et al. |
| 6,685,579 | B2 | 2/2004 | Sullivan |
| 6,685,580 | B2 | 2/2004 | Sullivan |
| 6,705,956 | B1 | 3/2004 | Moriyama et al. |
| 6,736,737 | B2 | 5/2004 | Higuchi et al. |
| 6,739,987 | B2 | 5/2004 | Harris et al. |
| 6,743,122 | B2 | 6/2004 | Hayashi et al. |
| 6,835,794 | B2 | 12/2004 | Wu et al. |
| 6,855,074 | B2 | 2/2005 | Kato |
| 6,855,793 | B2 | 2/2005 | Harris et al. |
| 6,867,279 | B2 | 3/2005 | Wu |
| 6,872,774 | B2 | 3/2005 | Sullivan et al. |
| 6,910,974 | B2 | 6/2005 | Watanabe |
| 6,949,595 | B2 | 9/2005 | Morgan et al. |
| 6,958,379 | B2 | 10/2005 | Wu et al. |
| 6,960,630 | B2 | 11/2005 | Cavallaro et al. |
| 6,964,621 | B2 | 11/2005 | Bulpett et al. |
| 6,966,849 | B2 | 11/2005 | Kato |
| 7,005,479 | B2 | 2/2006 | Morgan et al. |
| 7,037,217 | B2 | 5/2006 | Harris et al. |
| 7,041,769 | B2 | 5/2006 | Wu et al. |
| 7,105,623 | B2 | 9/2006 | Wu et al. |
| 7,131,915 | B2 | 11/2006 | Sullivan et al. |
| 7,186,777 | B2 | 3/2007 | Wu et al. |
| 7,331,878 | B2 | 2/2008 | Boehm et al. |
| 7,358,305 | B2 | 4/2008 | Rajagopalan |
| 7,427,243 | B2 | 9/2008 | Sullivan |
| 7,722,483 | B2 | 5/2010 | Morgan et al. |
| 2003/0158000 | A1 | 8/2003 | Kennedy, III et al. |
| 2004/0235587 | A1* | 11/2004 | Sullivan ..... A63B 37/008 473/371 |
| 2007/0149323 | A1* | 6/2007 | Morgan ..... A63B 37/12 473/378 |
| 2008/0254913 | A1 | 10/2008 | Morgan |
| 2009/0137343 | A1 | 5/2009 | Morgan et al. |
| 2010/0227711 | A1 | 9/2010 | Sullivan et al. |
| 2011/0046306 | A1 | 2/2011 | Serhatkulu |

* cited by examiner

GOLF BALLS HAVING TRANSLUCENT COVERS FORMED OF AROMATIC AND ALIPHATIC POLYURETHANES

CROSS-REFERENCE TO RELATED APPLICATIONS

This application is a continuation of co-pending, co-assigned U.S. patent application Ser. No. 13/361,248 filed Jan. 30, 2012, now allowed, which is a continuation-in-part of U.S. patent application Ser. No. 13/330,056 filed Dec. 19, 2011, now issued as U.S. Pat. No. 9,044,648 with an issue date of Jun. 2, 2015, which is a continuation-in-part of U.S. patent application Ser. No. 12/403,703 filed Mar. 13, 2009, now issued as U.S. Pat. No. 8,262,510 with an issue date of Sep. 11, 2012, the entire disclosures of which are hereby incorporated by reference.

BACKGROUND OF THE INVENTION

Field of the Invention

The present invention generally relates to golf balls having multi-layered covers, wherein at least one of the cover layers is substantially transparent. More particularly, the cover includes an inner cover layer made of an ionomer composition; an intermediate cover layer made of an aromatic polyurethane composition; and an outer cover layer made of an aliphatic polyurethane composition. In one preferred version, the outer cover layer is substantially transparent and the underlying intermediate cover layer is colored. Light-reflective fillers also may be added to the compositions. The resulting ball has pleasing aesthetics.

Brief Review of the Related Art

Manufacturers of golf balls are constantly looking at new materials for developing multi-piece solid golf balls. In general, the materials should be cost-effective, have good processability, and be capable of producing golf balls with desirable physical and playing performance properties. A two-piece solid golf ball basically includes a solid inner core protected by an outer cover. The inner core is made commonly of a rubber material such as natural and synthetic rubbers: styrene butadiene, polybutadiene, or polyisoprene. Highly neutralized ethylene acid copolymer ionomer resins (HNPs) also may be used to form the core. The outer cover is made commonly of thermoplastic or thermoset resins such as ionomers, polyolefins, polyamides, polyesters, polyurethanes, and polyureas. As new materials and manufacturing processes have become more economically feasible, multi-piece solid golf balls such as, for example, three-piece, four-piece, and five-piece balls have been introduced. Different materials are used in these golf ball constructions to impart specific properties and playing features to the ball.

For instance, in recent years, there has been high interest in using thermoset, castable polyurethanes and polyureas to make golf ball covers. Basically, polyurethane compositions contain urethane linkages formed by reacting an isocyanate group (—N═C═O) with a hydroxyl group (OH). Polyurethanes are produced by the reaction of a multi-functional isocyanate with a polyol in the presence of a catalyst and other additives. The chain length of the polyurethane prepolymer is extended by reacting it with a hydroxyl-terminated curing agent. Polyurea compositions, which are distinct from the above-described polyurethanes, also can be formed. In general, polyurea compositions contain urea linkages formed by reacting an isocyanate group (—N═C═O) with an amine group (NH or $NH_2$). The chain length of the polyurea prepolymer is extended by reacting the prepolymer with an amine curing agent. Hybrid compositions containing urethane and urea linkages also may be produced as discussed further below. In general, polyurethane and polyurea covered golf balls are described in the patent literature, for example, U.S. Pat. Nos. 5,334,673; 5,484,870; 6,476,176; 6,506,851; 6,867,279; 6,958,379; 6,960,630; 6,964,621; 7,041,769; 7,105,623; 7,131,915; and 7,186,777.

Particularly, Sullivan, US Patent Application Publication 2002/0151380 discloses a golf ball having a core and cover wherein the cover comprises: a) an inner cover layer having a first thickness and being disposed directly about the core; b) an outer cover layer having a second thickness no greater than about 0.050 inches; and c) an intermediate cover layer having a third thickness and being disposed between the inner and outer cover layers; wherein the outer cover layer comprises a composition formed of a reactive liquid material (thermoset material comprising polyurethane, polyurea, polyurethane ionomer, epoxy, or a mixture thereof) and the combination of the first, second, and third thickness is no greater than about 0.125 inches.

Sullivan et al., US Patent Application Publication 2004/0235587 discloses a golf ball having a core and a cover comprising: an inner cover layer; an outer cover layer having a material hardness of 60 Shore D or less; and an intermediate cover layer disposed between the inner and outer cover layers. At least two of the inner, intermediate, and outer cover layers comprise a non-ionomeric material. Preferably, the outer cover layer comprises a polyurethane, a polyurea, a copolymer of a polyurethane, a copolymer of a polyurea, or an interpenetrating polymer network.

As discussed above, isocyanates with two or more functional groups are used in producing polyurethane and polyurea polymers. Manufacturers often use aromatic isocyanates for several reasons including their high reactivity and costs benefits. It normally is more economically advantageous to use aromatic isocyanates over other isocyanate compounds, because the raw material costs for aromatic isocyanates are generally lower. Furthermore, the aromatic isocyanates are able to react with the hydroxyl or amine compounds and form a durable and tough polymer having a high melting point. The resulting polyurethane or polyurea generally has good mechanical strength and cut/shear-resistance. However, one disadvantage with using aromatic isocyanates is the polymeric reaction product tends to have poor light stability and may discolor upon exposure to light, particularly ultraviolet (UV) light. Because aromatic isocyanates are used as a reactant, some aromatic structures may be found in the reaction product. Such aromatic structures are inherently unstable and the resulting material tends to discolor when exposed over long time periods to UV light rays. Hence, UV light stabilizers are commonly added to the formulation, but the covers may still develop a yellowish appearance over prolonged exposure to sunlight. Thus, golf balls are normally painted with a white paint and then covered with a transparent coating to protect the ball's appearance.

In a second approach, aliphatic isocyanates are used to form the prepolymer. Examples of aliphatic isocyanates include, but are not limited to, isophorone diisocyanate (IPDI), 1,6-hexamethylene diisocyanate (HDI), 4,4'-dicyclohexylmethane diisocyanate ("$H_{12}$ MDI"), and homopolymers and copolymers thereof. These aliphatic isocyanates can provide polyurethane and polyurea polymers having good light stability but such polymers tend to have reduced mechanical strength and cut/shear-resistance.

As discussed above, golf ball covers having good light stability are needed. At the same time, the golf ball should have high tensile strength, impact durability, and cut/shear-resistance. The present invention provides multi-layered golf balls having such characteristics as well as other advantageous properties and features. In the present invention, the cover of the golf ball is essentially "split" into two separate and distinct layers, an aromatic polyurethane inner cover (which will become the intermediate cover layer in the three-layered cover of the present invention) and an aliphatic polyurethane outer cover layer. Each cover layer contributes to provide the optimum combination of physical; playing; cosmetic; and color-stable properties to the ball. In one particular version, the outer cover layer is substantially transparent and the underlying intermediate cover layer is colored. In another version, both the outer and intermediate cover layers are substantially transparent. Light-reflective fillers such as pearlescent pigments, glitter, and metallics may be added to the cover layers. Golf balls having appealing appearances and pleasing decorative effects may be made in accordance with this invention.

SUMMARY OF THE INVENTION

The present invention relates to multi-layered golf balls comprising a core and multi-layered cover, wherein the cover comprises an inner cover comprising: i) an ionomer composition containing at least 75 weight percent ethylene acid copolymer having acid groups such that at least 30% of the acid groups are neutralized; ii) an outer cover layer comprising a first polyurethane composition containing at least 75 weight percent aliphatic polyurethane; and iii) an intermediate cover layer comprising a second polyurethane composition containing at least 75 weight percent aromatic polyurethane. The intermediate cover layer is positioned between the inner and outer cover layers. Preferably, the total thickness of the multi-layered cover is no greater than 0.110 inches. At least one of the cover layers is substantially transparent. In one preferred version, the outer cover layer is substantially transparent. In another preferred version, the outer and intermediate cover layers are each substantially transparent. In yet another preferred version, each of the outer, intermediate, and inner cover layers is substantially transparent.

When the outer cover layer is substantially transparent and intermediate cover layer is colored, the intermediate cover layer contains a sufficient amount of coloring agent (for example dyes or pigments) to impart sufficient color and make the colored layer visible from the exterior of the ball. Also, light-reflective fillers such as pearlescent pigments, glitter, metalized films and foils, and mixtures thereof may be added to the cover layer compositions to provide special decorative effects. Particular pearlescent pigments include, for example, metalized pigments, mica-based pigments, borosilicate pigments, titanium dioxide pigments, iron oxide pigments, and mixtures thereof.

The inner, outer, and intermediate covers may further comprise additional polymers and additives. For example, the inner and outer covers may further comprise a polymer selected from the group consisting of aliphatic and aromatic polyurethanes, aliphatic and aromatic polyurethanes, and aliphatic and aromatic urethane-urea hybrids.

In one preferred embodiment, the total thickness of the cover is no greater than 0.095 inches. For example, the inner cover layer may have a thickness in the range of 0.010 to 0.050 inches; the outer cover layer may have a thickness of 0.004 to 0.020 inches, and the intermediate cover layer may have a thickness of 0.010 to 0.040 inches. More particularly, in one version, the thickness of the inner cover layer (ICt) is greater than the thickness of the outer cover layer (OCt); and the ICt is greater than the thickness of the intermediate cover layer (INTCt). In yet another version, the INTCt is greater than or equal to the OCt.

The present invention also includes a method for making a multi-layered golf ball. The method includes the steps of: a) dispensing a liquid mixture comprising a first reactive polyurethane prepolymer and chain-extender, the polyurethane prepolymer being formed from the reaction of an aliphatic diisocyanate and polyol, into lower and upper mold cavities and allowing the mixture to react and coat the interior surfaces of each mold cavity; b) cooling the coated lower and upper mold cavities; c) dispensing a liquid mixture comprising a second reactive polyurethane prepolymer and chain-extender, the polyurethane prepolymer being formed from the reaction of an aromatic diisocyanate and polyol, into the lower and upper mold cavities; d) placing an intermediate golf ball comprising at least a core into the lower or upper mold cavity containing the reactive liquid mixture comprising the second reactive polyurethane prepolymer; e) bringing the lower and upper mold cavities together under sufficient pressure so the liquid mixture reacts and forms a multi-layered cover over the intermediate golf ball; and f) removing the molded, multi-layered cover golf ball from the mold cavities.

The resulting ball has many advantageous physical properties including good cut/shear-resistance and impact durability along with optimum cosmetic, playing performance, and color-stable properties. More particularly, the substantially transparent covered ball has an appealing and decorative look.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
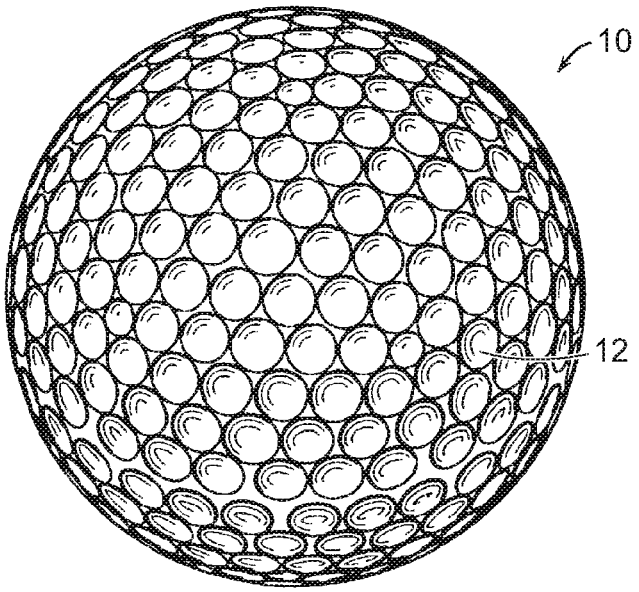
FIG. 1 is a front view of a dimpled golf ball made in accordance with the present invention.

The present invention relates generally to golf balls having multi-layered covers. The cover includes an inner cover layer made of an ionomer composition; an intermediate cover layer made of an aromatic polyurethane composition; and an outer cover layer made of an aliphatic polyurethane composition.

Golf balls having various constructions may be made in accordance with this invention. For example, golf balls having four-piece, five-piece, and six-piece constructions may be made. More particularly, in one version, a four-piece golf ball comprising a "single-layered" core and "three-layered" cover is made. In another version, a five-piece golf ball comprising a "dual-layered" core and "three-layered" cover is made. The dual-layered core has an inner core (center) and surrounding outer core layer. The term, "layer" or "layered" as used herein means generally any spherical portion of the golf ball. The golf ball may further include an intermediate layer. As used herein, the term, "intermediate layer" means a layer of the ball disposed between the core and cover. The intermediate layer also may be referred to as a casing or mantle layer. The diameter and thickness of the different layers along with properties such as hardness and compression may vary depending upon the construction and desired playing performance properties of the golf ball as discussed further below.

Core Structure

The golf ball may contain a single- or multi-layered core. In one preferred embodiment, at least one of the core layers is formed of a rubber composition comprising polybutadiene rubber material. More particularly, in one version, the ball contains a single inner core formed of the polybutadiene rubber composition. In a second version, the ball contains a dual-core comprising an inner core (center) and surrounding outer core layer.

In one version, the core is formed of a rubber composition comprising a rubber material such as, for example, polybutadiene, ethylene-propylene rubber, ethylene-propylene-diene rubber, polyisoprene, styrene-butadiene rubber, polyalkenamers, butyl rubber, halobutyl rubber, or polystyrene elastomers. For example, polybutadiene rubber compositions may be used to form the inner core (center) and surrounding outer core layer in a dual-layer construction. In another version, the core may be formed from an ionomer composition comprising an ethylene acid copolymer containing acid groups such that greater than 70% of the acid groups are neutralized. These highly neutralized polymers (HNPs) also may be used to form at least one core layer in a multi-layered core construction. For example, a polybutadiene rubber composition may be used to form the center and a HNP composition may be used to form the outer core. Such rubber and HNP compositions are discussed in further detail below.

In general, polybutadiene is a homopolymer of 1, 3-butadiene. The double bonds in the 1,3-butadiene monomer are attacked by catalysts to grow the polymer chain and form a polybutadiene polymer having a desired molecular weight. Any suitable catalyst may be used to synthesize the polybutadiene rubber depending upon the desired properties. Normally, a transition metal complex (for example, neodymium, nickel, or cobalt) or an alkyl metal such as alkyllithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. A preferred polybutadiene rubber has a 1,4 cis-bond content of at least 40%, preferably greater than 80%, and more preferably greater than 90%. In general, polybutadiene rubbers having a high 1,4 cis-bond content have high tensile strength. The polybutadiene rubber may have a relatively high or low Mooney viscosity.

Examples of commercially-available polybutadiene rubbers that can be used in accordance with this invention, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and NEODENE BR40, BR45, BR50 and BR60, available from Karbochem (PTY) Ltd. of Bruma, South Africa; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

To form the core, the polybutadiene rubber is used in an amount of at least about 5% by weight based on total weight of composition and is generally present in an amount of about 5% to about 100%, or an amount within a range having a lower limit of 5% or 10% or 20% or 30% or 40% or 50% and an upper limit of 55% or 60% or 70% or 80% or 90% or 95% or 100%. In general, the concentration of polybutadiene rubber is about 45 to about 95 weight percent. Preferably, the rubber material used to form the core layer comprises at least 50% by weight, and more preferably at least 70% by weight, polybutadiene rubber.

The rubber compositions of this invention may be cured, either by pre-blending or post-blending, using conventional curing processes. Suitable curing processes include, for example, peroxide-curing, sulfur-curing, high-energy radiation, and combinations thereof. Preferably, the rubber composition contains a free-radical initiator selected from organic peroxides, high energy radiation sources capable of generating free-radicals, and combinations thereof. In one preferred version, the rubber composition is peroxide-cured. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators are generally present in the rubber composition in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubbers, and an upper limit of 2.5 parts or 3 parts or 5 parts or 6 parts or 10 parts or 15 parts by weight per 100 parts of the total rubber. Concentrations are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

The rubber compositions preferably include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, and nickel. In a particular embodiment, the co-agent is selected from zinc salts of acrylates, diacrylates, methacrylates, and dimethacrylates. In another particular embodiment, the agent is zinc diacrylate (ZDA). When the co-agent is zinc diacrylate and/or zinc dimethacrylate, the co-agent is typically included in the rubber composition in an amount within the range having a lower limit of 1 or 5 or 10 or 15 or 19 or 20 parts by weight per 100 parts of the total rubber, and an upper limit of 24 or 25 or 30 or 35 or 40 or 45 or 50 or 60 parts by weight per 100 parts of the base rubber.

Radical scavengers such as a halogenated organosulfur or metal salt thereof, organic disulfide, or inorganic disulfide compounds may be added to the rubber composition. These compounds also may function as "soft and fast agents." As used herein, "soft and fast agent" means any compound or a blend thereof that is capable of making a core: 1) softer (having a lower compression) at a constant "coefficient of restitution" (COR); and/or 2) faster (having a higher COR at equal compression), when compared to a core equivalently prepared without a soft and fast agent. Preferred halogenated organosulfur compounds include, but are not limited to, pentachlorothiophenol (PCTP) and salts of PCTP such as zinc pentachlorothiophenol (ZnPCTP). Using PCTP and ZnPCTP in golf ball inner cores helps produce softer and faster inner cores. The PCTP and ZnPCTP compounds help increase the resiliency and the coefficient of restitution of the core. In a particular embodiment, the soft and fast agent is selected from ZnPCTP, PCTP, ditolyl disulfide, diphenyl disulfide, dixylyl disulfide, 2-nitroresorcinol, and combinations thereof.

The rubber compositions of the present invention also may include "fillers," which are added to adjust the density and/or specific gravity of the material. Suitable fillers include, but are not limited to, polymeric or mineral fillers, metal fillers, metal alloy fillers, metal oxide fillers and carbonaceous fillers. The fillers can be in any suitable form including, but not limited to, flakes, fibers, whiskers, fibrils, plates, particles, and powders. Rubber regrind, which is ground, recycled rubber material (for example, ground to about 30 mesh particle size) obtained from discarded rubber golf ball cores, also can be used as a filler. The amount and type of fillers utilized are governed by the amount and weight of other ingredients in the golf ball, since a maximum golf ball weight of 45.93 g (1.62 ounces) has been established by the United States Golf Association (USGA).

Suitable polymeric or mineral fillers that may be added to the rubber composition include, for example, precipitated hydrated silica, clay, talc, asbestos, glass fibers, aramid fibers, mica, calcium metasilicate, barium sulfate, zinc sulfide, lithopone, silicates, silicon carbide, tungsten carbide, diatomaceous earth, polyvinyl chloride, carbonates such as calcium carbonate and magnesium carbonate. Suitable metal fillers include titanium, tungsten, aluminum, bismuth, nickel, molybdenum, iron, lead, copper, boron, cobalt, beryllium, zinc, and tin. Suitable metal alloys include steel, brass, bronze, boron carbide whiskers, and tungsten carbide whiskers. Suitable metal oxide fillers include zinc oxide, iron oxide, aluminum oxide, titanium oxide, magnesium oxide, and zirconium oxide. Suitable particulate carbonaceous fillers include graphite, carbon black, cotton flock, natural bitumen, cellulose flock, and leather fiber. Micro balloon fillers such as glass and ceramic, and fly ash fillers can also be used. In a particular aspect of this embodiment, the rubber composition includes filler(s) selected from carbon black, nanoclays (e.g., Cloisite® and Nanofil® nanoclays, commercially available from Southern Clay Products, Inc., and Nanomax® and Nanomer® nanoclays, commercially available from Nanocor, Inc.), talc (e.g., Luzenac HAR® high aspect ratio talcs, commercially available from Luzenac America, Inc.), glass (e.g., glass flake, milled glass, and microglass), mica and mica-based pigments (e.g., Iriodin® pearl luster pigments, commercially available from The Merck Group), and combinations thereof. In a particular embodiment, the rubber composition is modified with organic fiber micropulp.

In addition, the rubber compositions may include antioxidants to prevent the breakdown of the elastomers. Also, processing aids such as high molecular weight organic acids and salts thereof, may be added to the composition. In a particular embodiment, the total amount of additive(s) and filler(s) present in the rubber composition is 15 wt % or less, or 12 wt % or less, or 10 wt % or less, or 9 wt % or less, or 6 wt % or less, or 5 wt % or less, or 4 wt % or less, or 3 wt % or less, based on the total weight of the rubber composition.

The polybutadiene rubber material (base rubber) may be blended with other elastomers in accordance with this invention. Other elastomers include, but are not limited to, polybutadiene, polyisoprene, ethylene propylene rubber ("EPR"), styrene-butadiene rubber, styrenic block copolymer rubbers (such as "SI", "SIS", "SB", "SBS", "SIBS", and the like, where "S" is styrene, "I" is isobutylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

The polymers, free-radical initiators, filler, crosslinking agents, and any other materials used in forming either the golf ball center or any portion of the core, in accordance with invention, may be combined to form a mixture by any type of mixing known to one of ordinary skill in the art. Suitable types of mixing include single pass and multi-pass mixing, and the like. The crosslinking agent, and any other optional additives used to modify the characteristics of the golf ball center or additional layer(s), may similarly be combined by any type of mixing. A single-pass mixing process where ingredients are added sequentially is preferred, as this type of mixing tends to increase efficiency and reduce costs for the process. The preferred mixing cycle is single step wherein the polymer, cis-to-trans catalyst, filler, zinc diacrylate, and peroxide are added in sequence.

The materials used in forming either the core or any portion of the multi-layered golf ball of this invention, may be combined and mixed together using any suitable mixing technique and equipment. Suitable mixing techniques include, for example, single-pass and multi-pass mixing. Suitable mixing equipment is known in the art, and such equipment may include a Banbury mixer, a two-roll mill, a twin-screw extruder, a pin-barrel extruder, or other conventional mixing equipment. Conventional mixing speeds for combining and blending polymers together are typically used. The mixing temperature depends upon the type of polymer components, and more importantly, on the type of free-radical initiator used in the composition. Suitable mixing speeds and temperatures are known in the art. In one embodiment, as discussed above, the core composition comprises polybutadiene rubber, zinc diacrylate, zinc oxide, stearic acid and/or zinc stearate, a filler such as barium sulfate, a peroxide or other cross-linking initiator, and optionally an organosulfur compound such as zinc pentachlorothiophenol (PCTP), and optionally an antioxidant, and colorant pigment or dye. The ingredients are mixed in an internal mixer such a Farrell Intermix mixer, two-roll mill, or any other suitable mixer for mixing rubber. The order of addition of ingredients and the time and temperature of mixing are important. Generally, the rubber and all ingredients (except peroxide) are mixed from about 1 to 30 minutes, and more preferably about 2 to 10 minutes at a temperature of about room temperature to about 200° F. The heat-sensitive peroxide initiator is added at a temperature of about 210° F. or less, preferably about 200° F. or less and mixed for a period of time that ensures good dispersion and uniform mixing of all ingredients. The temperature of the batch should not rise above the decomposition temperature of the peroxide, generally not exceeding 220° F., more preferably not above 210° F., whereupon the batch is discharged from the mixer onto a two-roll mill or a twin-screw sheeter or other device that allows the batch to cool for storage and testing prior to subsequent processing into preforms (generally, extrusion or barwell) and then molding. Alternatively, the subsequent processing steps of extrusion and molding may take place directly upon removal from the mixer, while the batch is still warm. A modified mixing method may be used to accommodate raw materials that are wet or contain higher than desirable levels of moisture or volatiles. For instance, such methods may be used when the polybutadiene rubber has a moisture content above about 0.10 wt. % water. Since it is desirable to keep the moisture content below about 0.10 wt. % water to achieve optimum properties in the molded core, the rubber, alone or with any combination of ingredients (except the initiator) is first charged into the mixer that may be at room temperature or may be preheated to a desired temperature at or above 212° F. These ingredients may include, for example, one or more of the following: zinc oxide, filler, zinc diacrylate, antioxidant and organosulfur compound, colorant, and any other rubber that may be in the formulation. The batch is mixed for a time period of from about 1 to 60 minutes (more preferably about 2-20 minutes and most preferably about 3 to 10 minutes) at a temperature of 212° F. or greater and may be 220°, 240°, or 260° F. or greater to "dry" the rubber or at least reduce the moisture and/or volatile content. While the batch is still mixing in the mixer, the temperature is reduced to about 210° F. or less, preferably about 200° F. or less. The decrease in temperature can be achieved by cooling the rotors, mixing chamber, and ram of the mixer using any combination of air or fluid (generally, water) and/or by reducing the rotor speed or stopping the rotors temporarily to minimize shearing forces. Then, the initiator is added and mixed to a drop or discharge temperature of under about 220° F., more preferably 210° F. or less.

Another alternative to the mixing cycle just described for reducing high moisture levels in polybutadiene is the double-pass mixing process. In the first pass of the mixing process, the polybutadiene is added to the mixer with some or all of the core ingredients, but specifically excluding the initiator. The mixer can be at room temperature or can already be at an elevated temperature of 212° F. or above. The batch is mixed to a stock temperature of 212° F. or greater for a period long enough to reduce moisture and to incorporate the added ingredients. The batch can then be discharged onto equipment such as a two-roll mill or twin-screw sheeter at an elevated temperature allowing for additional moisture reduction, followed by some cooling and batch storage. There is no requirement for reducing mixer or stock temperature in the first pass as no peroxide will be added. For the second part of the double-pass mixing, the first pass stock is re-added to the mixer along with the appropriate amount of peroxide initiator and mixed to a discharge temperature of 220° F. or less. Then, the batch is discharged onto the appropriate downstream equipment for cooling, batch storage/testing, and preform processing.

The mixture can be subjected to a compression or injection-molding process to obtain solid spheres for the center or hemispherical shells for forming an intermediate layer. The temperature and duration of the molding cycle are selected based upon reactivity of the mixture. The molding cycle may have a single step of molding the mixture at a single temperature for a fixed duration of time. The molding cycle may also include a two-step process, in which the polymer mixture is held in the mold at an initial temperature for an initial duration of time, followed by holding at a second, typically higher temperature for a second duration of time. Preferably a single-step cure cycle is employed. The curing time will depend on the various materials selected and can be adjusted upwardly or downwardly as needed.

In one preferred embodiment, the entire core or at least one core layer in a multi-layered structure is formed of a rubber composition comprising a material selected from the group of natural and synthetic rubbers including, but not limited to, polybutadiene, polyisoprene, ethylene propylene rubber ("EPR"), ethylene-propylene-diene ("EPDM") rubber, styrene-butadiene rubber, styrenic block copolymer rubbers (such as "SI", "SIS", "SB", "SBS", "SIBS", and the like, where "S" is styrene, "I" is isobutylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

Cover Structure

The inner cover can include any materials known to those of ordinary skill in the art, including thermoplastic and thermosetting materials, but preferably is formed of an ionomer composition comprising an ethylene acid copolymer containing acid groups that are at least partially neutralized. Suitable ethylene acid copolymers that may be used to form the compositions of this invention are generally referred to as copolymers of ethylene; $C_3$ to $C_8$ $\alpha,\beta$-ethylenically unsaturated mono- or dicarboxylic acid; and optional softening monomer. Copolymers may include, without limitation, ethylene acid copolymers, such as ethylene/(meth)acrylic acid, ethylene/(meth)acrylic acid/maleic anhydride, ethylene/(meth)acrylic acid/maleic acid monoester, ethylene/maleic acid, ethylene/maleic acid mono-ester, ethylene/(meth)acrylic acid/n-butyl (meth)acrylate, ethylene/(meth)acrylic acid/isobutyl (meth)acrylate, ethylene/(meth)acrylic acid/methyl (meth)acrylate, ethylene/(meth) acrylic acid/ethyl (meth)acrylate terpolymers, and the like. The term, "copolymer," as used herein, includes polymers having two types of monomers, those having three types of monomers, and those having more than three types of monomers. The preferred α,β-ethylenically unsaturated mono- or dicarboxylic acids are (meth) acrylic acid, ethacrylic acid, maleic acid, crotonic acid, fumaric acid, and itaconic acid. (Meth) acrylic acid is most preferred. As used herein, "(meth) acrylic acid" means methacrylic acid and/or acrylic acid. Likewise, "(meth) acrylate" means methacrylate and/or acrylate.

When a softening monomer is included, such copolymers are referred to herein as E/X/Y-type copolymers, wherein E is ethylene; X is a $C_3$ to $C_8$ α,β-ethylenically unsaturated mono- or dicarboxylic acid; and Y is a softening monomer. The softening monomer is typically an alkyl (meth) acrylate, wherein the alkyl groups have from 1 to 8 carbon atoms. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

Examples of commercially-available ionomer compositions that can be used in accordance with this invention, include, but are not limited to, Surlyn® ionomer resins and HPF® 1000 and HPF® 2000, commercially available from DuPont; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.

The amount of ethylene in the acid copolymer is typically at least 15 wt. %, preferably at least 25 wt. %, more preferably least 40 wt. %, and even more preferably at least 60 wt. %, based on total weight of the copolymer. The amount of $C_3$ to $C_8$ α,β-ethylenically unsaturated mono- or dicarboxylic acid in the acid copolymer is typically from 1 wt. % to 35 wt. %, preferably from 5 wt. % to 30 wt. %, more preferably from 5 wt. % to 25 wt. %, and even more preferably from 10 wt. % to 20 wt. %, based on total weight of the copolymer. The amount of optional softening comonomer in the acid copolymer is typically from 0 wt. % to 50 wt. %, preferably from 5 wt. % to 40 wt. %, more preferably from 10 wt. % to 35 wt. %, and even more preferably from 20 wt. % to 30 wt. %, based on total weight of the copolymer. "Low acid" and "high acid" ionomeric polymers, as well as blends of such ionomers, may be used. In general, low acid ionomers are considered to be those containing 16 wt. % or less of acid moieties, whereas high acid ionomers are considered to be those containing greater than 16 wt. % of acid moieties. In the present invention, the ionomer preferably has an acid content of at least about 9%, more preferably at least 11%, and most preferably in the range of 13% to 20%. Typically, the ionomer has an acid content of about 15%.

The acidic groups in the copolymeric ionomers are partially or totally neutralized with a cation source. Suitable cation sources include metal cations and salts thereof, organic amine compounds, ammonium, and combinations thereof. Preferred cation sources are metal cations and salts thereof, wherein the metal is preferably lithium, sodium, potassium, magnesium, calcium, barium, lead, tin, zinc, aluminum, manganese, nickel, chromium, copper, or a combination thereof. The metal cation salts provide the cations capable of neutralizing (at varying levels) the carboxylic acids of the ethylene acid copolymer and fatty acids, if present, as discussed further below. These include, for example, the sulfate, carbonate, acetate, oxide, or hydroxide salts of lithium, sodium, potassium, magnesium, calcium, barium, lead, tin, zinc, aluminum, manganese, nickel, chromium, copper, or a combination thereof. Preferred metal cation salts are calcium and magnesium-based salts. High surface area cation particles such as micro and nano-scale cation particles are preferred. The amount of cation used in the composition is readily determined based on desired level of neutralization.

For example, ionomeric resins having acid groups that are neutralized from about 10 percent to about 100 percent may be used. In one type of ionomer composition, the acid groups are partially neutralized. That is, the neutralization level is from about 10% to about 70%, more preferably 20% to 60%, and most preferably 30 to 50%. These ionomer compositions, containing acid groups neutralized to 70% or less, may be referred to ionomers having relatively low neutralization levels.

In another suitable ionomer composition, the acid groups are highly or fully-neutralized, and these materials may be referred to as highly neutralized polymers (HNPs). In these HNPs, the neutralization level is greater than 70%, preferably at least 90%, and even more preferably at least 100%. In another embodiment, an excess amount of neutralizing agent, that is, an amount greater than the stoichiometric amount needed to neutralize the acid groups, may be used. That is, the acid groups may be neutralized to 100% or greater, for example 110% or 120% or greater. In one preferred embodiment, a high acid ethylene acid copolymer containing about 19 to 20 wt. % methacrylic or acrylic acid is neutralized with zinc and sodium cations to a 95% neutralization level.

Ionic plasticizers such as organic acids or salts of organic acids, particularly fatty acids, may be added to the ionomer resin if needed. Such ionic plasticizers are used to make conventional ionomer composition more processable as described in Rajagopalan et al., U.S. Pat. No. 6,756,436, the disclosure of which is hereby incorporated by reference. In one preferred embodiment, the thermoplastic ionomer composition, containing acid groups neutralized to 70% or less, does not include a fatty acid or salt thereof, or any other ionic plasticizer. On the other hand, the thermoplastic ionomer composition, containing acid groups neutralized to greater than 70%, includes an ionic plasticizer, particularly a fatty acid or salt thereof. For example, the ionic plasticizer may be added in an amount of 0.5 to 10 pph, more preferably 1 to 5 pph. The organic acids may be aliphatic, mono- or multi-functional (saturated, unsaturated, or multi-unsaturated) organic acids. Salts of these organic acids may also be employed. Suitable fatty acid salts include, for example, metal stearates, laureates, oleates, palmitates, pelargonates, and the like. For example, fatty acid salts such as zinc stearate, calcium stearate, magnesium stearate, barium stearate, and the like can be used. The salts of fatty acids are generally fatty acids neutralized with metal ions. The metal cation salts provide the cations capable of neutralizing (at varying levels) the carboxylic acid groups of the fatty acids.

Examples include the sulfate, carbonate, acetate and hydroxide salts of metals such as barium, lithium, sodium, zinc, bismuth, chromium, cobalt, copper, potassium, strontium, titanium, tungsten, magnesium, cesium, iron, nickel, silver, aluminum, tin, or calcium, and blends thereof. For example, the ionic plasticizer may be added in an amount of 0.5 to 10 pph, more preferably 1 to 5 pph. In addition to the fatty acids and salts of fatty acids discussed above, other suitable ionic plasticizers include, for example, polyethylene glycols, waxes, bis-stearamides, minerals, and phthalates. In another embodiment, an amine or pyridine compound is used, preferably in addition to a metal cation. Suitable examples include, for example, ethylamine, methylamine, diethylamine, tert-butylamine, dodecylamine, and the like. It is preferred the organic acids and salts be relatively non-migratory (they do not bloom to the surface of the polymer under ambient temperatures) and non-volatile (they do not volatilize at temperatures required for melt-blending).

The golf balls of this invention further include intermediate and outer cover layers made of polyurethane compositions. In general, the polyurethane compositions contain urethane linkages formed by reacting an isocyanate group (—N═C═O) with a hydroxyl group (OH). The polyurethanes are produced by the reaction of a multi-functional isocyanate (NCO—R—NCO) with a long-chain polyol having terminal hydroxyl groups (OH—OH) in the presence of a catalyst and other additives. The chain length of the polyurethane prepolymer is extended by reacting it with short-chain diols (OH—R'—OH). The resulting polyurethane has elastomeric properties because of its "hard" and "soft" segments, which are covalently bonded together. This phase separation occurs because the mainly non-polar, low melting soft segments are incompatible with the polar, high melting hard segments. The hard segments, which are formed by the reaction of the diisocyanate and low molecular weight chain-extending diol, are relatively stiff and immobile. The soft segments, which are formed by the reaction of the diisocyanate and long chain diol, are relatively flexible and mobile. Because the hard segments are covalently coupled to the soft segments, they inhibit plastic flow of the polymer chains, thus creating elastomeric resiliency.

The polyurethanes used in accordance with this invention may be either thermoplastic or thermosetting materials. Thermoplastic polyurethanes have minimal cross-linking; any bonding in the polymer network is primarily through hydrogen bonding or other physical mechanism. Because of their lower level of cross-linking, thermoplastic polyurethanes are relatively flexible. The cross-linking bonds in thermoplastic polyurethanes can be reversibly broken by increasing temperature such as during molding or extrusion. That is, the theremoplastic material softens when exposed to heat and returns to its original condition when cooled. On the other hand, thermoset polyurethanes become irreversibly set when they are cured. The cross-linking bonds are irreversibly set and are not broken when exposed to heat. Thus, thermoset polyurethanes, which typically have a high level of cross-linking, are relatively rigid.

In one embodiment, a thermoplastic polyurethane composition comprising a thermoplastic polyurethane, a polysiloxane, an acetal polymer, and an acrylonitrile-butadiene-styrene copolymer, as disclosed in Serhatkulu, US Patent Application Publication US 2011/0046306, the disclosure of which is hereby incorporated by reference, may be used in accordance with this invention.

In the golf balls of the present invention, the intermediate cover layer comprises an aromatic polyurethane, which is preferably formed by reacting an aromatic diisocyanate with a polyol. Suitable aromatic diisocyanates that may be used in accordance with this invention include, for example, toluene 2,4-diisocyanate (TDI), toluene 2,6-diisocyanate (TDI), 4,4'-methylene diphenyl diisocyanate (MDI), 2,4'-methylene diphenyl diisocyanate (MDI), polymeric methylene diphenyl diisocyanate (PMDI), p-phenylene diisocyanate (PPDI), m-phenylene diisocyanate (PDI), naphthalene 1,5-diisocynate (NDI), naphthalene 2,4-diisocyanate (NDI), p-xylene diisocyanate (XDI), and homopolymers and copolymers and blends thereof. The aromatic isocyanates are able to react with the hydroxyl or amine compounds and form a durable and tough polymer having a high melting point. The resulting polyurethane generally has good mechanical strength and cut/shear-resistance.

Meanwhile, the outer cover layer comprises an aliphatic polyurethane, which is preferably formed by reacting an aliphatic diisocyanate with a polyol. Suitable aliphatic diisocyanates that may be used in accordance with this invention include, for example, isophorone diisocyanate (IPDI), 1,6-hexamethylene diisocyanate (HDI), 4,4'-dicyclohexylmethane diisocyanate ("$H_{12}$ MDI"), meta-tetramethylxylylene diisocyanate (TMXDI), trans-cyclohexane diisocyanate (CHDI), and homopolymers and copolymers and blends thereof. The resulting polyurethane generally has good light and thermal stability.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. In still another embodiment, polycaprolactone polyols are included in the materials of the invention. Suitable polycaprolactone polyols include, but are not limited to: 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups. In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

There are two basic techniques that can be used to make the polyurethane compositions of this invention: a) one-shot technique, and b) prepolymer technique. In the one-shot technique, the diisocyanate, polyol, and hydroxyl-terminated chain-extender (curing agent) are reacted in one step. On the other hand, the prepolymer technique involves a first reaction between the diisocyanate and polyol compounds to produce a polyurethane prepolymer, and a subsequent reaction between the prepolymer and hydroxyl-terminated chain-extender. As a result of the reaction between the isocyanate and polyol compounds, there will be some unreacted NCO groups in the polyurethane prepolymer. The prepolymer should have less than 14% unreacted NCO groups. Preferably, the prepolymer has no greater than 8.5% unreacted NCO groups, more preferably from 2.5% to 8%, and most preferably from 5.0% to 8.0% unreacted NCO groups. As the weight percent of unreacted isocyanate groups increases, the hardness of the composition also generally increases.

Either the one-shot or prepolymer method may be employed to produce the polyurethane compositions of the invention. In one embodiment, the one-shot method is used, wherein the isocyanate compound is added to a reaction vessel and then a curative mixture comprising the polyol and curing agent is added to the reaction vessel. The components are mixed together so that the molar ratio of isocyanate groups to hydroxyl groups is in the range of about 1.01:1.00 to about 1.10:1.00. Preferably, the molar ratio is greater than 1.05:1.00. For example, the molar ratio can be in the range of 1.07:1.00 to 1.10:1.00. In a second embodiment, the prepolymer method is used. In general, the prepolymer technique is preferred because it provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

The polyurethane compositions can be formed by chain-extending the polyurethane prepolymer with a single chain-extender or blend of chain-extenders as described further below. The compositions of the present invention may be selected from among both castable thermoplastic and thermoset polyurethanes. Thermoplastic polyurethane compositions are typically formed by reacting the isocyanate blend and polyols at a 1:1 stoichiometric ratio. Thermoset compositions, on the other hand, are cross-linked polymers and are typically produced from the reaction of the isocyanate blend and polyols at normally a 1.05:1 stoichiometric ratio. In general, thermoset polyurethane compositions are easier to prepare than thermoplastic polyurethanes.

As discussed above, the polyurethane prepolymer can be chain-extended by reacting it with a single chain-extender or blend of chain-extenders. In general, the prepolymer can be reacted with hydroxyl-terminated curing agents, amine-terminated curing agents, and mixtures thereof. The curing agents extend the chain length of the prepolymer and build-up its molecular weight. Normally, the prepolymer and curing agent are mixed so the isocyanate groups and hydroxyl or amine groups are mixed at a 1.05:1.00 stoichiometric ratio.

A catalyst may be employed to promote the reaction between the isocyanate and polyol compounds for producing the prepolymer or between prepolymer and chain-extender during the chain-extending step. Preferably, the catalyst is added to the reactants before producing the prepolymer. Suitable catalysts include, but are not limited to, bismuth catalyst; zinc octoate; stannous octoate; tin catalysts such as bis-butyltin dilaurate, bis-butyltin diacetate, stannous octoate; tin (II) chloride, tin (IV) chloride, bis-butyltin dimethoxide, dimethyl-bis[1-oxonedecyl)oxy]stannane, di-n-octyltin bis-isooctyl mercaptoacetate; amine catalysts such as triethylenediamine, triethylamine, and tributylamine; organic acids such as oleic acid and acetic acid; delayed catalysts; and mixtures thereof. The catalyst is preferably added in an amount sufficient to catalyze the reaction of the components in the reactive mixture. In one embodiment, the catalyst is present in an amount from about 0.001 percent to about 1 percent, and preferably 0.1 to 0.5 percent, by weight of the composition.

The hydroxyl chain-extending (curing) agents are preferably selected from the group consisting of ethylene glycol; diethylene glycol; polyethylene glycol; propylene glycol; 2-methyl-1,3-propanediol; 2-methyl-1,4-butanediol; monoethanolamine; diethanolamine; triethanolamine; monoisopropanolamine; diisopropanolamine; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; N,N,N',N'-tetra-(2-hydroxypropyl)-ethylene diamine; diethylene glycol bis-(aminopropyl) ether; 1,5-pentanediol; 1,6-hexanediol; 1,3-bis-(2-hydroxyethoxy) cyclohexane; 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol (PTMEG), preferably having a molecular weight from about 250 to about 3900; and mixtures thereof.

Suitable amine chain-extending (curing) agents that can be used in chain-extending the polyurethane prepolymer include, but are not limited to, unsaturated diamines such as 4,4'-diamino-diphenylmethane (i.e., 4,4'-methylene-dianiline or "MDA"), m-phenylenediamine, p-phenylenediamine, 1,2- or 1,4-bis(sec-butylamino)benzene, 3,5-diethyl-(2,4- or 2,6-) toluenediamine or "DETDA", 3,5-dimethylthio-(2,4- or 2,6-)toluenediamine, 3,5-diethylthio-(2,4- or 2,6-)toluenediamine, 3,3'-dimethyl-4,4'-diamino-diphenylmethane, 3,3'-diethyl-5,5'-dimethyl4,4'-diamino-diphenylmethane (i.e., 4,4'-methylene-bis(2-ethyl-6-methyl-benezeneamine)), 3,3'-dichloro-4,4'-diamino-diphenylmethane (i.e., 4,4'-methylene-bis(2-chloroaniline) or "MOCA"), 3,3',5,5'-tetraethyl-4,4'-diamino-diphenylmethane (i.e., 4,4'-methylene-bis(2,6-diethylaniline), 2,2'-dichloro-3,3',5,5'-tetraethyl-4,4'-diamino-diphenylmethane (i.e., 4,4'-methylene-bis(3-chloro-2,6-diethyleneaniline) or "MCDEA"), 3,3'-diethyl-5,5'-dichloro-4,4'-diamino-diphenylmethane, or "MDEA"), 3,3'-dichloro-2,2',6,6'-tetraethyl-4,4'-diamino-diphenylmethane, 3,3'-dichloro-4,4'-diamino-diphenylmethane, 4,4'-methylene-bis(2,3-dichloroaniline) (i.e., 2,2',3,3'-tetrachloro-4,4'-diamino-diphenylmethane or "MDCA"), 4,4'-bis(sec-butylamino)-diphenylmethane, N,N'-dialkylamino-diphenylmethane, trimethyleneglycol-di (p-aminobenzoate), polyethyleneglycol-di(p-aminobenzoate), polytetramethyleneglycol-di(p-aminobenzoate); saturated diamines such as ethylene diamine, 1,3-propylene diamine, 2-methyl-pentamethylene diamine, hexamethylene diamine, 2,2,4- and 2,4,4-trimethyl-1,6-hexane diamine, imino-bis(propylamine), imido-bis(propylamine), methyl-imino-bis(propylamine) (i.e., N-(3-aminopropyl)-N-methyl-1,3-propanediamine), 1,4-bis(3-aminopropoxy)butane (i.e., 3,3'-[1,4-butanediylbis-(oxy)bis]-1-propanamine), diethyleneglycol-bis(propylamine) (i.e., diethyleneglycol-di (aminopropyl)ether), 4,7,10-trioxatridecane-1,13-diamine, 1-methyl-2,6-diamino-cyclohexane, 1,4-diamino-cyclohexane, poly(oxyethylene-oxypropylene) diamines, 1,3- or 1,4-bis(methylamino)-cyclohexane, isophorone diamine, 1,2- or 1,4-bis(sec-butylamino)-cyclohexane, N,N'-diisopropyl-isophorone diamine, 4,4'-diamino-dicyclohexylmethane, 3,3'-dimethyl-4,4'-diamino-dicyclohexylmethane, 3,3'-dichloro-4,4'-diamino-dicyclohexylmethane, N,N'-dialkylamino-dicyclohexylmethane, polyoxyethylene diamines, 3,3'-diethyl-5,5'-dimethyl-4,4'-diamino-dicyclohexylmethane, polyoxypropylene diamines, 3,3'-diethyl-5,5'-dichloro-4,4'-diamino-dicyclohexylmethane, polytetramethylene ether diamines, 3,3',5,5'-tetraethyl-4,4'-diamino-dicyclohexylmethane (i.e., 4,4'-methylene-bis(2,6-diethylaminocyclohexane)), 3,3'-dichloro-4,4'-diamino-dicyclohexylmethane, 2,2'-dichloro-3,3',5,5'-tetraethyl-4,4'-diamino-dicyclohexylmethane, (ethylene oxide)-capped polyoxypropylene ether diamines, 2,2',3,3'-tetrachloro-4,4'-diamino-dicyclohexylmethane, 4,4'-bis(sec-butylamino)-dicyclohexylmethane; triamines such as diethylene triamine, dipropylene triamine, (propylene oxide)-based triamines (i.e., polyoxypropylene triamines), N-(2-aminoethyl)-1,3-propylenediamine (i.e., $N_3$-amine), glycerin-based triamines, (all saturated); tetramines such as N,N'-bis(3-aminopropyl)ethylene diamine (i.e., $N_4$-amine) (both saturated), triethylene tetramine; and other polyamines such as tetraethylene pentamine (also saturated). One suitable amine-terminated chain-extending agent is Ethacure 300™ (dimethylthiotoluenediamine or a mixture of 2,6-diamino-3,5-dimethylthiotoluene and 2,4-diamino-3,5-dimethylthiotoluene.) The amine curing agents used as chain extenders normally have a cyclic structure and a low molecular weight (250 or less).

When the polyurethane prepolymer is reacted with hydroxyl-terminated curing agents during the chain-extending step, as described above, the resulting polyurethane composition contains urethane linkages. On the other hand, when the polyurethane prepolymer is reacted with amine-terminated curing agents during the chain-extending step, any excess isocyanate groups in the prepolymer will react with the amine groups in the curing agent. The resulting polyurethane composition contains urethane and urea linkages and may be referred to as a polyurethane/urea hybrid. The concentration of urethane and urea linkages in the hybrid composition may vary. In general, the hybrid composition may contain a mixture of about 10 to 90% urethane and about 90 to 10% urea linkages.

As discussed above, a polyurethane composition comprising an aromatic polyurethane is used to form the intermediate cover layer. The aromatic polyurethane is used in an amount of at least about 10% by weight based on total weight of composition and is generally present in an amount of about 10% to about 100%, or an amount within a range having a lower limit of 20% or 30% or 40% or 50% or 60% or 70% or 75% and an upper limit of 80% or 85% or 90% or 95% or 100%. Preferably, the concentration of aromatic polyurethane is at least 40% and more preferably about 40% to about 100%, and even more preferably at least 75% or about 75% to about 100%. Meanwhile, a polyurethane composition comprising aliphatic polyurethane is used to form the outer cover layer. The aliphatic polyurethane is used in an amount of at least about 10% by weight based on total weight of composition and is generally present in an amount of about 10% to about 100%, or an amount within a range having a lower limit of 20% or 30% or 40% or 50% or 60% or 70% or 75% and an upper limit of 80% or 85% or 90% or 95% or 100%. Preferably, the concentration of aliphatic polyurethane is at least 40% and more preferably about 40% to about 100%, and even more preferably at least 75% or about 75% to about 100%.

The polyurethane compositions used to form the intermediate and outer cover layers may contain other polymer materials including, for example: aliphatic or aromatic polyurethanes, aliphatic or aromatic polyureas, aliphatic or aromatic polyurethane/urea hybrids, olefin-based copolymer ionomer compositions, polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, available from Arkema Inc; cross-linked trans-polyisoprene and blends thereof; polyester-based thermoplastic elastomers, such as Hytrel®, available from DuPont; polyurethane-based thermoplastic elastomers, such as Elastollan®, available from BASF; polycarbonate/polyester blends such as Xylex®, available from SABIC Innovative Plastics; maleic anhydride-grafted polymers such as Fusabond®, available from DuPont; and mixtures of the foregoing materials.

In addition, the polyurethane compositions may contain fillers, additives, and other ingredients that do not detract from the properties of the final composition. These additional materials include, but are not limited to, catalysts, wetting agents, coloring agents, optical brighteners, cross-linking agents, whitening agents such as titanium dioxide and zinc oxide, ultraviolet (UV) light absorbers, hindered amine light stabilizers, defoaming agents, processing aids, surfactants, and other conventional additives. Other suitable additives include antioxidants, stabilizers, softening agents, plasticizers, including internal and external plasticizers, impact modifiers, foaming agents, density-adjusting fillers, reinforcing materials, compatibilizers, and the like. Some examples of useful fillers include zinc oxide, zinc sulfate, barium carbonate, barium sulfate, calcium oxide, calcium carbonate, clay, tungsten, tungsten carbide, silica, and mixtures thereof. Rubber regrind (recycled core material) and polymeric, ceramic, metal, and glass microspheres also may be used. Generally, the additives will be present in the composition in an amount between about 1 and about 70 weight percent based on total weight of the composition depending upon the desired properties.

Golf Ball Construction

The solid cores for the golf balls of this invention may be made using any suitable conventional technique such as, for example, compression or injection molding, Typically, the cores are formed by compression molding a slug of uncured or lightly cured rubber material into a spherical structure. Prior to forming the cover layer, the core structure may be surface-treated to increase the adhesion between its outer surface and adjacent layer. Such surface-treatment may include mechanically or chemically-abrading the outer surface of the core. For example, the core may be subjected to corona-discharge, plasma-treatment, silane-dipping, or other treatment methods known to those in the art. The cover layers are formed over the core or ball subassembly (the core structure and any intermediate layers disposed about the core) using a suitable technique such as, for example, compression-molding, flip-molding, injection-molding, retractable pin injection-molding, reaction injection-molding (RIM), liquid injection-molding, casting, spraying, powder-coating, vacuum-forming, flow-coating, dipping, spin-coating, and the like. Prior to forming the cover layers, the ball subassembly may be surface-treated to increase the adhesion between its outer surface and the overlying cover material using the above-described techniques.

Preferably, each cover layer is separately formed over the ball subassembly. First, the inner cover layer comprising the ionomer composition is formed using a conventional technique such as, for example, compression or injection molding. For example, the ionomer composition used to form the inner cover is preferably injection-molded to produce semi-cured, semi-rigid half shells. Alternatively, the ionomer composition can be placed into a compression mold and molded under sufficient pressure, temperature, and time to produce the hemispherical shells. The smooth-surfaced hemispherical shells are then placed around the ball subassembly in a compression mold. Under sufficient heating and pressure, the shells fuse together to form an inner cover layer that surrounds the subassembly. Alternatively, the ionomer composition is injection-molded directly onto the core using retractable pin injection molding.

In one embodiment, the intermediate cover layer comprising the second polyurethane composition (aromatic polyurethane) is next formed by molding the aromatic polyurethane composition over the inner cover layer using a conventional technique such as, for example, a casting process. After the aromatic polyurethane composition has sufficiently cured, the outer cover layer comprising the first polyurethane composition (aliphatic polyurethane) is molded over the intermediate cover layer.

In a preferred embodiment, the method for forming the intermediate (aromatic polyurethane) and outer cover (aliphatic polyurethane) layers involve the following steps. First, a liquid mixture of reactive polyurethane prepolymer and chain-extender (curing agent) used to form the outer cover layer ("the first polyurethane composition") is poured into lower and upper mold cavities (half-shells), which may be pre-heated (normally at a temperature of about 125° to about 300° F.). The reactive polyurethane prepolymer and chain extender are allowed to at least partially react and form a solid or semi-solid thin coating (skin) over the interior surfaces of the mold cavities. In general, the thickness of this coating is in the range of about 0.004 to about 0.050 inches, more preferably about 0.006 to about 0.040 inches or about 0.008 to about 0.030 inches or even more preferably about 0.012 to about 0.018 inches. Any excess reactive liquid mixture should be removed after this skin-coating of the interior mold cavity surfaces. For example, excess liquid may be poured out of the cavities. In an optional step, the skin-coated mold cavities are allowed to cool before the next reactive polyurethane composition is introduced into the molds. Alternatively, in an optional step, the skin-coated mold cavities are heated prior to adding the next reactive polyurethane composition.

Next, a liquid mixture of reactive polyurethane prepolymer and chain-extender (curing agent) used to form the inner cover layer ("the second polyurethane composition") is poured into the skin-coated lower and upper mold cavities. After this second polyurethane reactive mixture has resided in the lower mold cavity for a sufficient time period (typically about 40 to about 100 seconds), the intermediate golf ball (core structure and surrounding inner cover layer) is lowered at a controlled speed into the reactive mixture. Ball suction cups can hold the intermediate ball in place via reduced pressure or partial vacuum. After sufficient gelling of the reactive mixture (typically about 4 to about 12 seconds), the vacuum is removed and the intermediate ball is released into the mold cavity. Then, the upper mold cavity is mated with the lower mold cavity under sufficient pressure and heat. An exothermic reaction occurs when the polyurethane prepolymer and chain extender are mixed and this continues until the cover material encapsulates and solidifies around the intermediate ball. Finally, the molded balls are cooled in the mold and removed when the molded cover is hard enough so that it can be handled without deforming.

In yet another embodiment, the liquid mixture of reactive polyurethane prepolymer and chain-extender (curing agent) used to form the outer cover layer ("the first polyurethane composition") may be sprayed into the lower and upper mold cavities to form a thin layer which subsequently is cured. In still another embodiment, a cured thin film of polyurethane is first formed and then is stamped or vacuum-molded into the shape of a half-shell, which then is compression-molded into a dimpled half-shell which ultimately is molded around a ball subassembly.

After the golf balls have been removed from the mold, they may be subjected to finishing steps such as flash-trimming, surface-treatment, marking, coating, and the like using techniques known in the art. For example, in traditional white-colored golf balls, the white-pigmented cover may be surface-treated using a suitable method such as, for example, corona, plasma, or ultraviolet (UV) light-treatment. Then, indicia such as trademarks, symbols, logos, letters, and the like may be printed on the ball's cover using pad-printing, ink-jet printing, dye-sublimation, or other suitable printing methods. Clear surface coatings (for example, primer and top-coats), which may contain a fluorescent whitening agent, are applied to the cover. The resulting golf ball has a glossy and durable surface finish.

In another finishing process, the golf balls are painted with one or more paint coatings. For example, white primer paint may be applied first to the surface of the ball and then a white top-coat of paint may be applied over the primer. Of course, the golf ball may be painted with other colors, for example, red, blue, orange, and yellow. As noted above, markings such as trademarks and logos may be applied to the painted cover of the golf ball. Finally, a clear surface coating may be applied to the cover to provide a shiny appearance and protect any logos and other markings printed on the ball.

Colored Golf Balls

As discussed above, in one version, the balls of this invention have a traditional white-colored cover. In another version, the cover has a non-traditional color such as, for example, red, blue, orange, or yellow. The cover also can be multi-colored. The colored pigments or dyes in the cover layer provide an opaque surface by absorbing the incident light at selective wavelengths. In general, the pigments only absorb certain light wavelengths of the visible spectrum (red, orange, yellow, green, and blue), and the wavelengths, which are not absorbed, are transmitted back to give the appearance of a specific color. Balls having unique aesthetics also may be made. For example, the outer cover layer may be optically translucent or transparent so that the underlying components of the ball can be seen.

More particularly, in one version, the outer cover layer is substantially transparent and the underlying intermediate cover layer is colored so that the color is visible to a person looking at the exterior of the ball. A sufficient amount of colorant (for example, dyes, pigments, and mixtures thereof) is added to impart the desired color to the underlying layer. In another version, the underlying intermediate cover layer contains light-reflective fillers, optical brighteners, glitter specks, metallics, particularly metalized films and foils, and the like to provide special decorative effects. The outer cover layer also may contain such light-reflective and colored additives as discussed further below. Also, when the outer cover layer is substantially transparent, the outer cover layer preferably contains ultraviolet (UV) light absorbers, light stabilizers, and the like. The UV light absorbers and stabilizers serve as filters to help prevent harmful UV light rays from penetrating through the cover layer, thereby helping to maintain good color-stability in the ball. The UV light absorbers, light stabilizers, and the like also may be added to the intermediate and inner cover layers in accordance with this invention.

The substantially transparent polymeric matrix comprising the outer, intermediate, and/or inner cover layers is sufficiently free of light-reflective fillers, pigments, dyes, fluorescent materials, optical brighteners, glitter specks, metallic, and the like so that it can admit the necessary amount of light for making the underlying layers in the golf ball visible. The substantially transparent layer(s) may allow a given measured amount of light to pass through so the layer(s) is formally characterized as being optically transparent, semi-transparent, translucent, or the like. It is recognized that in some instances it may be desirable to include a relatively small amount of such additives in the polymeric matrix to enhance the decorative effect. For example, light-reflective fillers including, but not limited to, pearlescent pigments, glitter specks, metallics, particularly metalized films and foils, and mixtures thereof can be incorporated into the polymeric matrix; provided, the matrix remains substantially clear.

Pearlescent pigments are particularly preferred, because these materials provide a pearly luster effect. Pearlescent pigment is generally made up of multiple platelet-like semi-transparent particles. When light strikes the platelets, it is partially reflected and partially transmitted through them. There are many platelet surfaces in parallel orientation and many layers of pigment at different depths within the pearlescent pigment-containing paint, coating, or other composition. As light reflects off the platelet surfaces in the different layers, this creates a pearly luster effect. A person looking at the composition will see different reflections and scattering of light depending upon their viewing angle. Some pearlescent pigments do not have a layered structure, that is, they comprise discrete particles and do not contain coated substrates. For example, metal-effect pearlescent pigments such as aluminum, copper, copper-zinc (bronze) alloys, and zinc particles may be used. Basic lead carbonate and bismuth oxychloride pigment particles also can be used. Other pearlescent pigments have a layered structure, that is, they contain a substrate. For example, natural or synthetic mica platelets may be coated with iron oxide or titanium dioxide to form special effect pearlescent pigments. Organic pigments also can be crystallized to form pigment flakes and pigments having a natural pearlescence such as pigment suspensions derived from fish scales may be used.

Metallics, particularly metalized films and foils, and glitter specks, which comprise very small plastic pieces painted in metallic, neon, and iridescent colors to reflect light also can be used as reflective fillers in accordance with this invention. Any suitable metal, especially highly lustrous metals, may be used and these metallics can be in the form of flakes, particles, and the like. Metalized polyester films and aluminum foil are also highly reflective metallics that can be used in the various layers of the golf ball.

Titanium dioxide pigment is preferably used as light-reflective filler, because of its light scattering properties including reflectivity and refraction. As the light strikes the surface of the composition, most of the light will be reflected because of the titanium dioxide pigment concentration. The light strikes the surface of the pigment (which has a relatively high refractive index in contrast to the binder resin), the light is bent and reflected outwardly. The portion of light which is not reflected will pass through the particles and will be bent in different direction. Other useful metal (or metal alloy) flakes, plates, powders, and particles that may be used in the polymer compositions include, for example, bismuth boron, brass, bronze, cobalt, copper, nickel, chrome, iron, molybdenum, nickel powder, stainless steel, zirconium aluminum, tungsten metal, beryllium metal, zinc, or tin. Other metal oxides may include zinc oxide, iron oxide, aluminum oxide, magnesium oxide, zirconium oxide, and tungsten trioxide also may be suitable.

In other instances, the substantially transparent polymeric matrix may be lightly colored or tinted. For example, a relatively small amount of colored pigments such as blue, green, red, or yellow pigments or the like may be blended in the polymeric matrix to impart some color to the layer. Suitable pigments include nickel and chrome titanates, chrome yellow, cadmium types, carbon black, chrome oxide green types, phthalocyanine blue or green, perylene and quinacridone types, and other conventional pigments. Pigment extenders include, for example, barytes, heavy spar, microtalc, kaolin, micaceous iron oxide, magnesium mica, quartz flour, powdered slate, and silicon carbide. Color flop pigments, as disclosed in Ohira et al, U.S. Pat. Nos. 7,018,307 and 6,558,277, which show a change in color as the viewing angle changes may be used in accordance with the present invention. Edge-effect pigments, which are attracted to the edges or sharper contours of the surfaces to which they are applied, also may be used.

The colored pigments provide opacity by absorbing the incident light at selective wavelengths. In general, the pigments only absorb certain light wavelengths of the visible spectrum (red, orange, yellow, green, and blue). The light frequencies, which are not absorbed, are transmitted back to give the appearance of a specific color. Thus, in colored layers, the incident light rays that strike the surface of the layer are selectively absorbed so the layer appears opaquely colored. Such a colored layer can provide color vibrancy and depth to the substantially transparent surrounding cover layer(s). Thus, a person looking through the substantially transparent cover can see a richly colored background. Different colored cores and decorative inserts can be used to create different coloring effects. In another example, the substantially transparent cover layer can be lightly colored. The colored cover material, which lies above the composite layer, and the colored core, which lies beneath the composite layer, can provide the ball with color striking highlights.

Likewise, if a fluorescent effect is desired, a relatively small amount of fluorescent dye may be added to the substantially transparent polymeric matrix. Suitable fluorescent dyes include, for example, dyes from the thioxanthene, xanthene, perylene, perylene imide, coumarin, thioindigoid, naphthalimide and methine dye classes. Representative yellow fluorescent dye examples include, but are not limited to: Lumogen F Orange™ 240 (BASF, Rensselaer, N.Y.); Lumogen F Yellow™ 083 (BASF, Rensselaer, N.Y.); Hostasol Yellow™ 3G (Hoechst-Celanese, Somerville, N.J.); Oraset Yellow™ 8GF (Ciba-Geigy, Hawthorne, N.Y.); Fluorol 088™ (BASF, Rensselaer, N.Y.); Thermoplast F Yellow™ 084 (BASF, Rensselaer, N.Y.); Golden Yellow™ D-304 (DayGlo, Cleveland, Ohio); Mohawk Yellow™ D-299 (DayGlo, Cleveland, Ohio); Potomac Yellow™ D-838

(DayGlo, Cleveland, Ohio) and Polyfast Brilliant Red™ SB (Keystone, Chicago, Ill.) Conventional non-fluorescent dyes also may be used including, but not limited to, azo, heterocyclic azo, anthraquinone, benzodifuranone, polycyclic aromatic carbonyl, indigoid, polymethine, styryl, di- and triaryl carbonium, phthalocyanines, quinopphthalones, sulfur, nitro and nitroso, stilbene, and formazan dyes.

Optical brighteners, which typically emit a bluish light, also may be added to the polymer composition. In general, optical brighteners absorb the invisible ultra-violet portion of the daylight spectrum and convert this energy into the longer-wavelength visible portion of the spectrum. Suitable optical brighteners include, for example, stilbene derivatives, styryl derivatives of benzene and biphenyl, bis(benzazol-2-yl) derivatives, coumarins, carbostyrils, naphthalimides, derivatives of dibenzothiophene-5,5-dioxide, pyrene derivatives, and pyridotriazoles. In accordance with the present invention, any of these or other known optical brighteners including derivatives of 4,4'-diamino stilbene-2,2'-disulfonic acid, 4-mthyl-7-diethylamino coumarin and 2,5-bis(5-tert-butyl)-2-benzoxazolyl)thiophene.

As discussed above, in one embodiment, the outer cover layer is substantially transparent and the underlying intermediate layer comprises colorants and/or other decorative additives. In another embodiment, the outer cover layer and intermediate cover layer are both substantially transparent; and the inner cover layer is opaque so that it can be seen through the outer and intermediate cover layers. The inner cover layer may contain the above-described light-reflective fillers, optical brighteners, glitter specks, metallics, pigments, dyes, fluorescent materials, and other additives. In yet another embodiment, version, each of the cover layers is substantially transparent, and the underlying core may be seen through these layers. In this version, the core, which is visible through the substantially transparent cover layers, may contain the above-described light-reflective fillers, optical brighteners, glitter specks, metallics, pigments, dyes, fluorescent materials, and other additives.

As discussed above, the lower and upper mold cavities are mated together to form the outer cover layer for the ball. The outer cover material encapsulates the inner ball. The mold cavities used to form the outer layer have interior dimple cavity details. The cover material conforms to the interior geometry of the mold cavities to form a dimple pattern on the surface of the ball. The mold cavities may have any suitable dimple arrangement such as, for example, icosahedral, octahedral, cube-octahedral, dipyramid, and the like. In addition, the dimples may be circular, oval, triangular, square, pentagonal, hexagonal, heptagonal, octagonal, and the like. Possible cross-sectional shapes include, but are not limited to, circular arc, truncated cone, flattened trapezoid, and profiles defined by a parabolic curve, ellipse, semi-spherical curve, saucer-shaped curve, sine or catenary curve, or conical curve. Other possible dimple designs include dimples within dimples, constant depth dimples, or multi-lobe dimples, as disclosed in U.S. Pat. No. 6,749,525. It also should be understood that more than one shape or type of dimple may be used on a single ball, if desired.

The use of various dimple patterns and profiles provides a relatively effective way to modify the aerodynamic characteristics of a golf ball. Suitable dimple patterns include, for example, icosahedron-based pattern, as described in U.S. Pat. No. 4,560,168; octahedral-based dimple patterns as described in U.S. Pat. No. 4,960,281; and tetrahedron-based patterns as described in co-assigned, co-pending, U.S. patent application Ser. No. 12/894,827, the disclosure of which is hereby incorporated by reference. Other tetrahedron-based dimple designs are shown in co-assigned, co-pending design applications D 29/362,123; D 29/362,124; D 29/362,125; and D 29/362,126, the disclosures of which are hereby incorporated by reference.

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment, the golf balls of the invention have a dimple coverage of the surface area of the cover of at least about 60 percent, preferably at least about 65 percent, and more preferably at least 70 percent or greater. Dimple patterns having even higher dimple coverage values may also be used with the present invention. Thus, the golf balls of the present invention may have dimple coverage of at least about 75 percent or greater, about 80 percent or greater, or even about 85 percent or greater.

The total number of dimples on the ball, or dimple count, may vary depending such factors as the sizes of the dimples and the pattern selected. In general, the total number of dimples on the ball preferably is between about 100 to about 1000 dimples, although one skilled in the art would recognize that differing dimple counts within this range can significantly alter the flight performance of the ball. In one embodiment, the dimple count is about 300-360 dimples. In one embodiment, the dimple count on the ball is about 360-400 dimples.

Thickness and Hardness of Golf Balls

The multi-layered cover of the golf balls of this invention provide the ball with a variety of advantageous mechanical and playing performance properties as discussed further below. In general, the hardness, diameter, and thickness of the different cover layers may vary depending upon the desired ball construction. Preferably, the inner cover layer hardness (material) is about 50 Shore D or greater, more preferably about 55 Shore D or greater, and most preferably about 60 Shore D or greater. In one embodiment, the inner cover has a Shore D hardness of about 62 to about 90 Shore D. In another embodiment, the inner cover has a Shore D hardness of about 64 to about 76 Shore D, and in yet another version, the inner cover has a Shore D hardness of about 66 to about 72 Shore D. More particularly, in one example, the inner cover has a hardness of about 68 Shore D or greater. The relationship between the various cover layers is also important in the construction of the golf ball of this invention. Preferably, the inner cover layer hardness is greater than the intermediate cover layer hardness by at least 5 Shore D units, and the inner cover layer hardness preferably is greater than the outer cover layer hardness by at least 5 Shore D Units. In addition, the thickness of the inner cover layer is preferably about 0.015 inches to about 0.100 inches, more preferably about 0.020 inches to about 0.080 inches, and most preferably about 0.030 inches to about 0.050 inches. Typically, the thickness of the inner cover is about 0.035 or 0.040 or 0.045 inches.

As discussed above, the hardness of the intermediate cover layer is preferably less than the hardness of the inner cover layer. However, the hardness of the intermediate cover layer is preferably about equal to or greater than the hardness of the outer cover layer. More preferably, the difference between the intermediate cover layer hardness and outer cover layer hardness is no greater than 5 Shore D units. Particularly, the intermediate cover layer preferably has a material hardness of 70 Shore D or less, or 65 Shore D or less, or 60 Shore D or less, or 55 Shore D or less. Preferably, the intermediate cover has a Shore D hardness (material) in the range of about 25 Shore D to about 60 Shore D, more preferably about 38 to about 50 Shore D. In other embodiments, however, the intermediate cover has a hardness of greater than 70 Shore D, for example, 75 Shore D or greater. Also, the thickness of the intermediate cover layer is preferably about equal to or greater than the thickness of the outer cover layer. More particularly, the thickness of the inner cover layer is preferably about 0.005 inches to about 0.040 inches, more preferably about 0.010 inches to about 0.035 inches, and most preferably about 0.015 inches to 0.030 inches.

One key feature of the golf balls of this invention is their relatively thin outer cover layers. The outer cover preferably has a thickness within a range having a lower limit of 0.004 or 0.006 or 0.008 and an upper limit of 0.010 or 0.020 or 0.030 or 0.040 inches. Preferably, the thickness of the outer cover is about 0.016 inches or less, more preferably 0.008 inches or less. As discussed above, the hardness of the outer cover layer is preferably about equal to or less than the hardness of the intermediate cover layer. The outer cover preferably has a material hardness of 60 Shore D or less, or 55 Shore D or less, or 50 Shore D or less, or 50 Shore D or less, or 45 Shore D or less. Preferably, the outer cover has a Shore D hardness in the range of about 25 to about 50.

In general, the inner cover layer is relatively stiff having a relatively high flex modulus of 40,000 psi or greater, more preferably 50,000 psi or greater, most preferably 60,000 psi or greater; while the intermediate and outer cover layers are more flexible preferably having a relatively low flex modulus of less than 50,000 psi, more preferably less than 40,000 psi. The relatively high modulus materials preferably have a modulus within the range of 50,000 psi to 120,000 psi. The relatively low modulus materials preferably have a modulus within the range of 1,000 psi to 49,000 psi. As discussed above, the relationship between the three separate and distinct cover layers helps impart different properties to the golf ball. Preferably, the flex modulus of the inner cover layer is greater than the intermediate cover layer hardness by at least 5,000 psi; and the flex modulus of the inner cover layer is preferably greater than the flex modulus of the outer cover layer by at least 5,000 psi.

The United States Golf Association ("USGA") has set total weight limits for golf balls. Particularly, the USGA has established a maximum weight of 45.93 g (1.62 ounces) for golf balls. There is no lower weight limit. In addition, the USGA requires that golf balls used in competition have a diameter of at least 1.68 inches. There is no upper limit so many golf balls have an overall diameter falling within the range of about 1.68 to about 1.80 inches. The golf ball diameter is preferably about 1.68 to 1.74 inches, more preferably about 1.68 to 1.70 inches. In accordance with the present invention, the weight, diameter, and thickness of the core and cover layers may be adjusted, as needed, so the ball meets USGA specifications of a maximum weight of 1.62 ounces and a minimum diameter of at least 1.68 inches. Preferably, the overall diameter of the core and inner and intermediate layers is about 90 percent to about 98 percent of the overall diameter of the finished ball. The outer cover layer made of the polyurethane composition of this invention is relatively thin and the diameter of the outer cover layer preferably is less than 2% of the overall diameter of the finished ball.

The combination of an inner cover layer comprising an ionomer composition; an intermediate cover layer comprising an aromatic polyurethane composition; and an outer cover layer comprising an aliphatic polyurethane composition provides the ball with optimum properties. The cover of this golf ball is essentially "split" into three separate and distinct layers, wherein each cover layer contributes to the overall good physical and playing properties of the ball. For example, the multi-layered cover has good durability and toughness. The different hardness and thickness levels of the cover layers provide the ball with high impact durability and cut-, shear- and tear-resistance levels. In addition, the multi-layered cover, in combination with the core layer, helps impart high resiliency to the golf balls. Preferably, the golf ball has a Coefficient of Restitution (COR) of at least 0.750 and more preferably at least 0.800 (as measured per the test methods below.) The core of the golf ball generally has a compression in the range of about 50 to about 130 and more preferably in the range of about 70 to about 110 (as measured per the test methods below.) These properties allow players to generate greater ball velocity off the tee and achieve greater distance with their drives. At the same time, the relatively thin outer cover layer means that a player will have a more comfortable and natural feeling when striking the ball with a club. The ball is more playable and its flight path can be controlled more easily. This control allows the player to make better approach shots near the green. Furthermore, the outer covers of this invention have good light stability. The outer covers have high ultraviolet light (UV)-resistance and are less likely to discolor upon exposure to sunlight. In summary, the golf balls of this invention have good light stability without sacrificing important mechanical properties such as durability and high cut/shear-resistance.

As discussed above, the method of this invention is particularly effective in providing golf balls having a very thin outer cover layer. Furthermore, the method of this invention provides thin outer covers with substantially uniform thickness. The resulting balls of this invention have good impact durability and cut/shear-resistance.

Referring to FIG. 1, a front view of a finished golf ball that can be made in accordance with this invention is generally indicated at (10). The dimples (12) may have various shapes and be arranged in various patterns to modify the aerodynamic properties of the ball as discussed in detail above.

Figure 2:
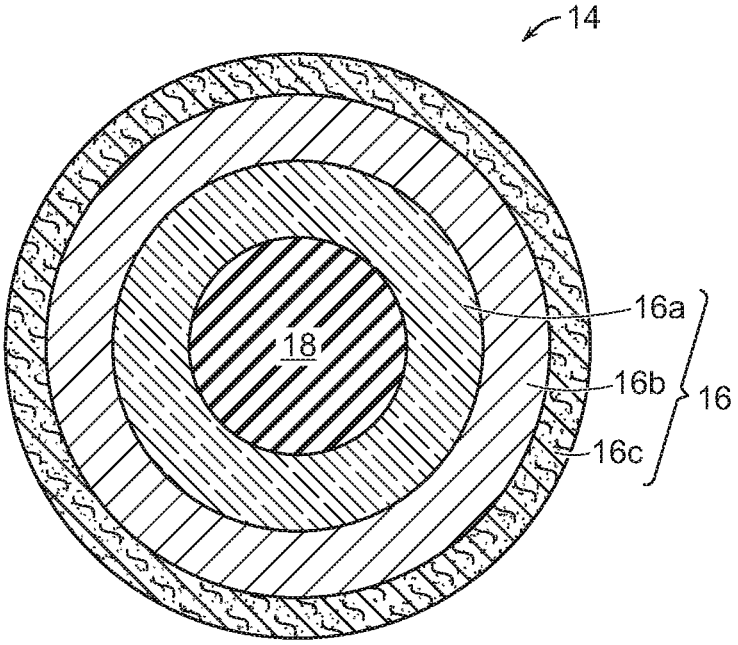
FIG. 2 is a cross-sectional view of a four-piece golf ball having a core and multi-layered cover made in accordance with the present invention.
Figure 3:
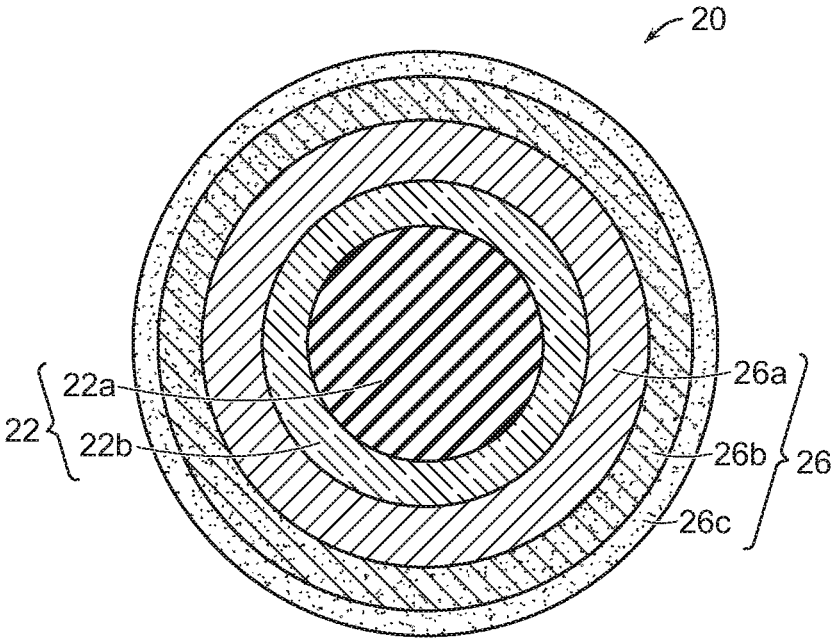
FIG. 3 is a cross-sectional view of a five-piece golf ball having a dual-core and multi-layered cover made in accordance with the present invention.
Figure 4:
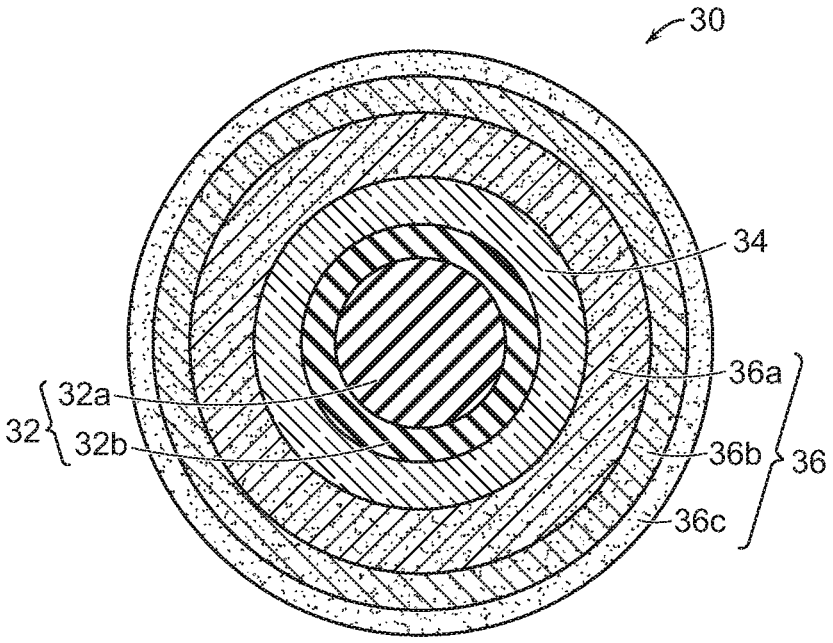
FIG. 4 is a cross-sectional view of a six-piece golf ball having a dual-core; an intermediate layer; and multi-layered cover made in accordance with the present invention.

In FIG. 2, a four-piece golf ball (14) with a multi-layered cover (16) comprising inner cover layer (16*a*), intermediate cover layer (16*b*), and substantially transparent outer cover layer (16*c*) is shown. The ball (14) further includes a solid, one-piece core (18). Turning to FIG. 3, the five-piece ball (20) includes a dual-core (22) comprising an inner core (center) (22*a*) and surrounding outer core layer (22*b*). The multi-layered cover (26) encapsulates the core structure (22) and includes inner (26*a*), substantially transparent intermediate (26*b*), and substantially transparent outer (26*c*) cover layers. Finally, in FIG. 4, a six-piece ball (30) containing a dual-core (32) comprising inner (32*a*) and outer core layers (32*b*) is shown. An intermediate layer (34) is disposed between the core structure (32) and multi-layered cover (36). The intermediate layer (34) also may be referred to as a casing layer. The intermediate layer (34) preferably has good water vapor barrier properties to prevent moisture from penetrating into the core material. The ball may include one or more intermediate layers (34) disposed between the core (32) and cover (36) structures. The multi-layered cover (36) includes substantially transparent inner (36*a*), intermediate (36*b*), and outer (36*c*) cover layers.

It should be understood that the golf balls shown in FIGS. 1-4 are for illustrative purposes only and not meant to be restrictive. Other golf ball constructions can be made in accordance with this invention.

Test Methods

Hardness:

The surface hardness of a golf ball layer or other spherical surface is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements and is set to take hardness readings at 1 second after the maximum reading is obtained. The digital durometer must be attached to and its foot made parallel to the base of an automatic stand. The weight on the durometer and attack rate conforms to ASTM D-2240.

It should be understood there is a fundamental difference between "material hardness" and "hardness as measured directly on a golf ball." For purposes of the present invention, material hardness is measured according to ASTM D-2240 and generally involves measuring the hardness of a flat "slab" or "button" formed of the material. Surface hardness, as measured directly on a golf ball (or other spherical surface), typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

Coefficient of Restitution (COR):

The COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The COR is then calculated as the ratio of the ball's outgoing transit time period to the ball's incoming transit time period ($COR=V_{out}/V_{in}=T_{in}/T_{out}$).

Modulus:

As used herein, the term, "modulus" refers to flexural modulus which is the ratio of stress to strain within the elastic limit (when measured in the flexural mode) and is similar to tensile modulus. This property is used to indicate the bending stiffness of a material. The flexural modulus, which is a modulus of elasticity, is determined by calculating the slope of the linear portion of the stress-strain curve during the bending test. If the slope of the stress-strain curve is relatively steep, the material has a relatively high flexural modulus meaning the material resists deformation. The material is more rigid. If the slope is relatively flat, the material has a relatively low flexural modulus meaning the material is more easily deformed. The material is more flexible. Flexural modulus can be determined in accordance with ASTM D-790 standard among other testing procedures.

Compression:

As used herein, the term "compression" refers to "Atti compression" and is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. When the Atti Gauge is used to measure cores having a diameter of less than 1.680 inches, it should be understood that a metallic or other suitable shim is used to normalize the diameter of the measured object to 1.680 inches When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

All patents, publications, test procedures, and other references cited herein, including priority documents, are fully incorporated by reference to the extent such disclosure is not inconsistent with this invention and for all jurisdictions in which such incorporation is permitted. It is understood that the compositions and golf ball products described and illustrated herein represent only some embodiments of the invention. It is appreciated by those skilled in the art that various changes and additions can be made to compositions and products without departing from the spirit and scope of this invention. It is intended that all such embodiments be covered by the appended claims.

We claim:

1. A golf ball, comprising:

a core, and a multi-layered cover having three layers, the multi-layered cover comprising:

i) a substantially transparent inner cover layer comprising an ionomer composition containing ethylene add copolymer having acid groups such that at least 30% of the acid groups are neutralized, the ethylene add copolymer being present in an amount of at least 10 weight percent;

ii) a substantially transparent outer cover layer comprising a first polyurethane composition containing aliphatic polyurethane and light-reflective fillers, the aliphatic polyurethane being present in an amount of at least 75 weight percent based on weight of composition; and iii) a substantially transparent Intermediate cover layer disposed between the inner cover layer and outer cover layer the intermediate layer comprising a second polyurethane composition containing aromatic polyurethane and light-reflective fillers, the aromatic polyurethane being present in an amount of at least 75 weight percent based on weight of composition so that the core is visible to a person looking at the exterior of the ball, wherein the total thickness of the multi-layered cover is no greater than 0.110 inches.

2. The golf ball of claim 1, wherein the light-reflective fillers in the first and second polyurethane compositions are selected from the group consisting of pearlescent pigments, glitter, metalized films and foils, and mixtures thereof.

3. The golf ball of claim 2, wherein the light-reflective fillers are pearlescent pigments selected from the group consisting of metalized pigments, mica-based pigments, borosilicate pigments, titanium dioxide pigments, iron oxide pigments, and mixtures thereof.

* * * * *